US005447003A

United States Patent [19]

Warren et al.

[11] Patent Number: 5,447,003

[45] Date of Patent: Sep. 5, 1995

[54] METHOD AND APPARATUS FOR INSULATING A LUMBER KILN

[76] Inventors: Russell D. Warren; Charles D. Womac, both of 1008 N. 37nd St., Birmingham, Ala. 35234

[21] Appl. No.: 525,555

[22] Filed: May 17, 1990

[51] Int. Cl.[6] ..... F04C 1/00; F26B 19/00

[52] U.S. Cl. ..... 52/309.1; 34/201

[58] Field of Search ..... 34/9.5, 13.4, 13.8, 34/201

[56] References Cited

U.S. PATENT DOCUMENTS 3,971,139 7/1976 Rochon ..... 34/13.8

4,296,540 10/1981 Potter ..... 34/9.5 X 4,774,773 10/1988 Zwyssig ..... 34/201

*Primary Examiner*—Henry A. Bennet

*Attorney, Agent, or Firm*—L. F. Hilbers

[57] ABSTRACT

A lumber predrying/drying kiln comprises a multiplicity of panels, a multiplicity of mats, and resin. Each panel comprises a multiplicity of plates and a block of insulation. The plates comprise fibrous glass strands embedded in a resin. The plates surround and encapsulate each block of insulation. Panels are placed next to each other, and above and/or below each other, end-to-end, to form walls and a roof of the kiln. They are connected with several alternating layers of fiberglass mats and resin wide enough to cover the joint between, and rigidly and structurally connect, the panels.

2 Claims, 4 Drawing Sheets

METHOD AND APPARATUS FOR INSULATING A LUMBER KILN

BACKGROUND OF THE INVENTION

I. Field of the Invention

This invention relates generally to a method and apparatus for insulating a kiln, and more particularly for insulating a kiln for drying lumber and for insulating a lumber predrying building, with walls that are virtually impervious to caustic moisture.

II. Prior Art and other Considerations

Kiln drying lumber is done in a high temperature atmosphere of nearly 100% relative humidity. The kiln drying building must be well insulated to hold the appropriate heat in the building. In the past, if moisture reached the insulation material, the insulation material lost most of its effectiveness rendering the building substantially unusable without repair.

It is expedient, therefore, that all moisture be kept from the insulation. In the kiln drying process the high temperatures and the acid released by the drying process are highly corrosive. The combination of high temperature, high humidity and high acidity, with pH frequently ranging to nearly as low as 3.0, defeat most attempts to keep moisture from the insulation in the building walls. The insulation technology used in lower temperature, lower humidity situations has not proven to be useful for kiln drying lumber.

Prior kiln drying buildings have been constructed using panels made of insulation encapsulated by aluminum cladding. The panels were prefabricated. The panels were joined to construct a building by aluminum extrusions and bolts or by lap joints with mechanical bolts. These kiln panels deteriorate very rapidly from a combination of thermal cycling, high relative humidity, and acid from the wood drying process. The insulation in the panels quickly become moist reducing its insulation value, and requiring replacement of the panel. The panels have also proven difficult and expensive to install as well as unattractive once installed.

Prior refrigeration insulation technology has not been concerned with the problems inherent in a high temperature, high relative humidity, high acidity environment. These conditions lead to corrosive conditions not faced in refrigeration type situations.

SUMMARY

In view of the foregoing, it is an object of the present invention to provide a durable method and a durable apparatus for effectively insulating kiln drying and predrying buildings for drying lumber.

An advantage of the present invention is the provision of a method and apparatus wherein the insulation is protected from exposure to almost all moisture.

An advantage of the present invention is the provision of a method and apparatus for prefabricating panels facilitating speedy, low cost fabrication, construction, implementaion and installation.

Another advantage of the present invention is the provision of a method and apparatus for facilitating a desired kiln structural strength and integrity and durability.

A further advantage of the present invention is the provision of a method and apparatus for facilitating a neat appearance of the kiln drying building all through its lifetime.

Yet another advantage of the present invention is the provision of a method and apparatus for a durable building that can withstand high temperature, withstand high relative humidity and particularly withstand concentrated acidity.

Still another advantage of the present invention is the provision of a method and apparatus for a predrying and drying lumber that has elements which strong enough to support elements in a building structure including itself and other elements.

An effectively insulated, durable lumber drying kiln, including an effectively insulated, durable lumber predrying kiln, comprises a building comprising a paneling means and a connecting means. The paneling means comprises an insulating means surrounded by an encapsulating means which is virtually waterproof so that virtually no moisture can reach the insulating means. The encapsulating means can withstand environments which are high in temperature and high in relative humidity and can withstand environments, most importantly, which are strongly acidic. The insulating means is also highly resistant to degradation by moisture and is nearly impervious to moisture. The connecting means STRUCTURALLY joins a number of paneling means together to form the building that is durable in a manner whereby the abilities to withstand harsh inside environments, such as high in temperature, high in relative humidity, and strongly acidic, are not significantly, if at all, diminished.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
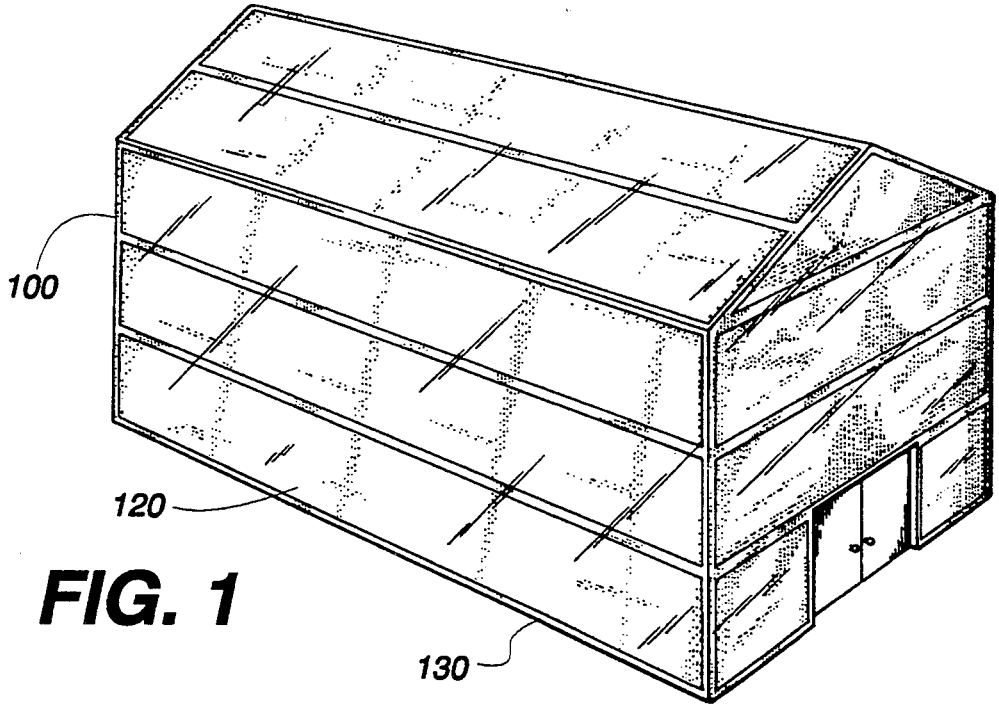
FIG. 1 is a perspective view of a first preferred embodiment of a lumber drying kiln comprising a plurality of connected panels.
Figure 2:
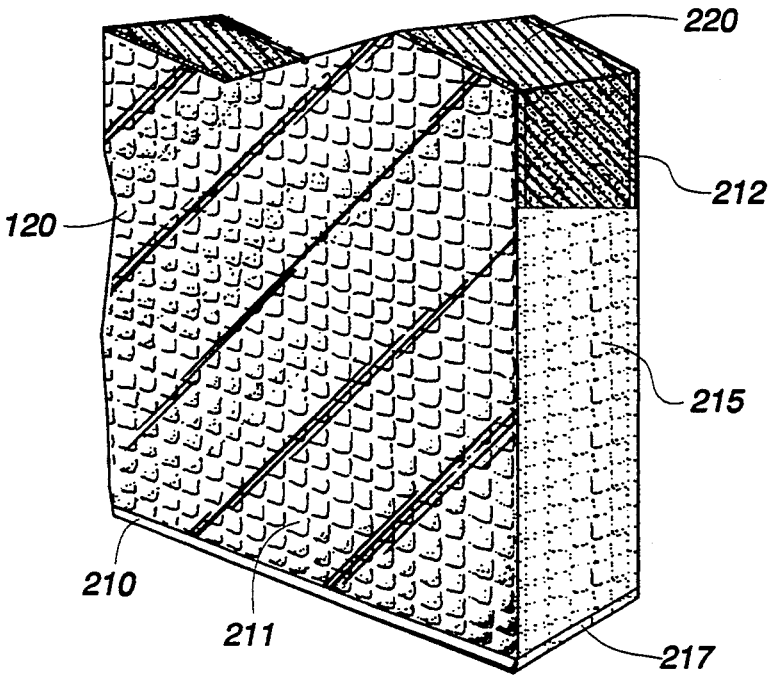
FIG. 2 is an enlarged cross sectional perspective view of one panel of the kiln of FIG. 1.

A first preferred embodiment of lumber drying kiln of a FIG. 1 comprises a building 100 having a multiplicity of panels 120 and a multiplicity of connecting means 130. As shown in FIG. 2, each panel 120 comprises a number of plates 210 and an insulating block 220. Each panel 120 has a front surface plate 211, a back surface plate 212, two (2) side end plates 215, a bottom end plate 217 and a top end plate 218. Consequently, every surface of each block 220 is covered by, and rigidly attached to, a plate 210. Each plate 210 comprises fibrous glass strands embedded in a resin which completely encapsulate the insulating block 220. The plates 210 are virtually impervious to moisture. These plates 210 are connected to each other at all points where they intersect using the fibrous glass strands embedded in a resin so that the plates 210 completely seal the block 220 into the interior of the volume defined by said plates 210 so that virtually no moisture can reach the insulation 220. Blocks 220 are typically composed of polyisosianurate.

Figure 3:
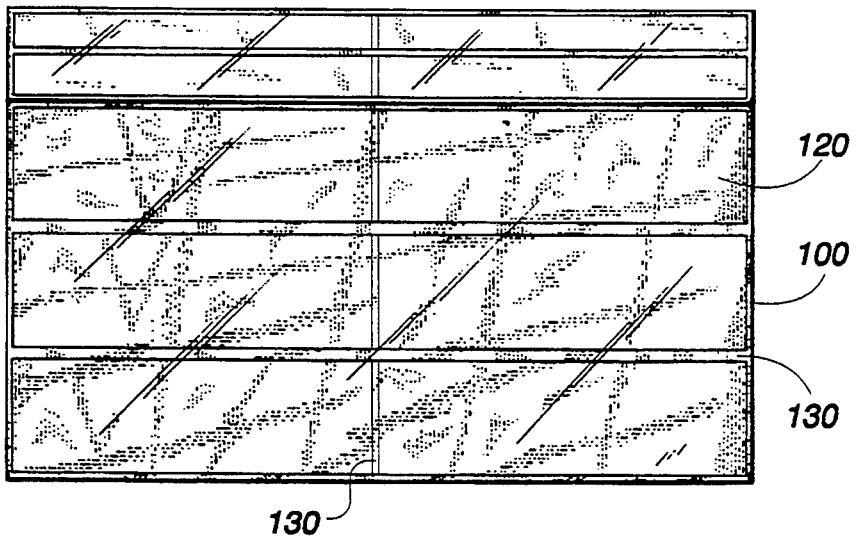
FIG. 3 is a left side elevational view of the kiln of FIG. 1.

As shown in FIG. 3, panels 120 are placed side by side, side end plate 215 of one panel 120 to side end plate 215 of the next panel 120, next to each other Then they are placed above and/or below each other, generally top end plate 218 of one panel 120 to bottom end plate 217 of an adjacent panel 120. Panels 120 positioned thusly are rigidly joined together with connecting means 130 to form the building 100.

Figure 4:
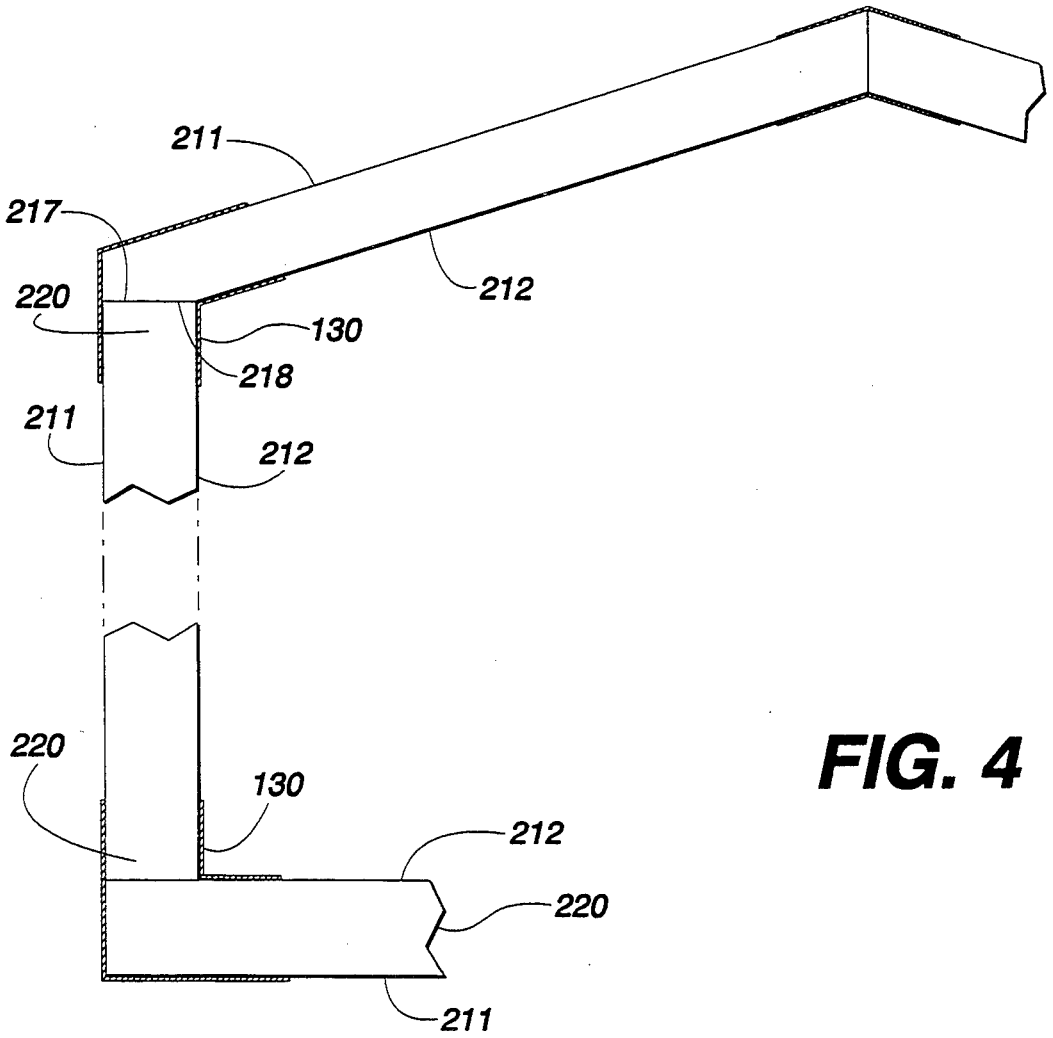
FIG. 4 is a cross sectional view of the connection of panels of the kiln of FIG. 1.
Figure 5:
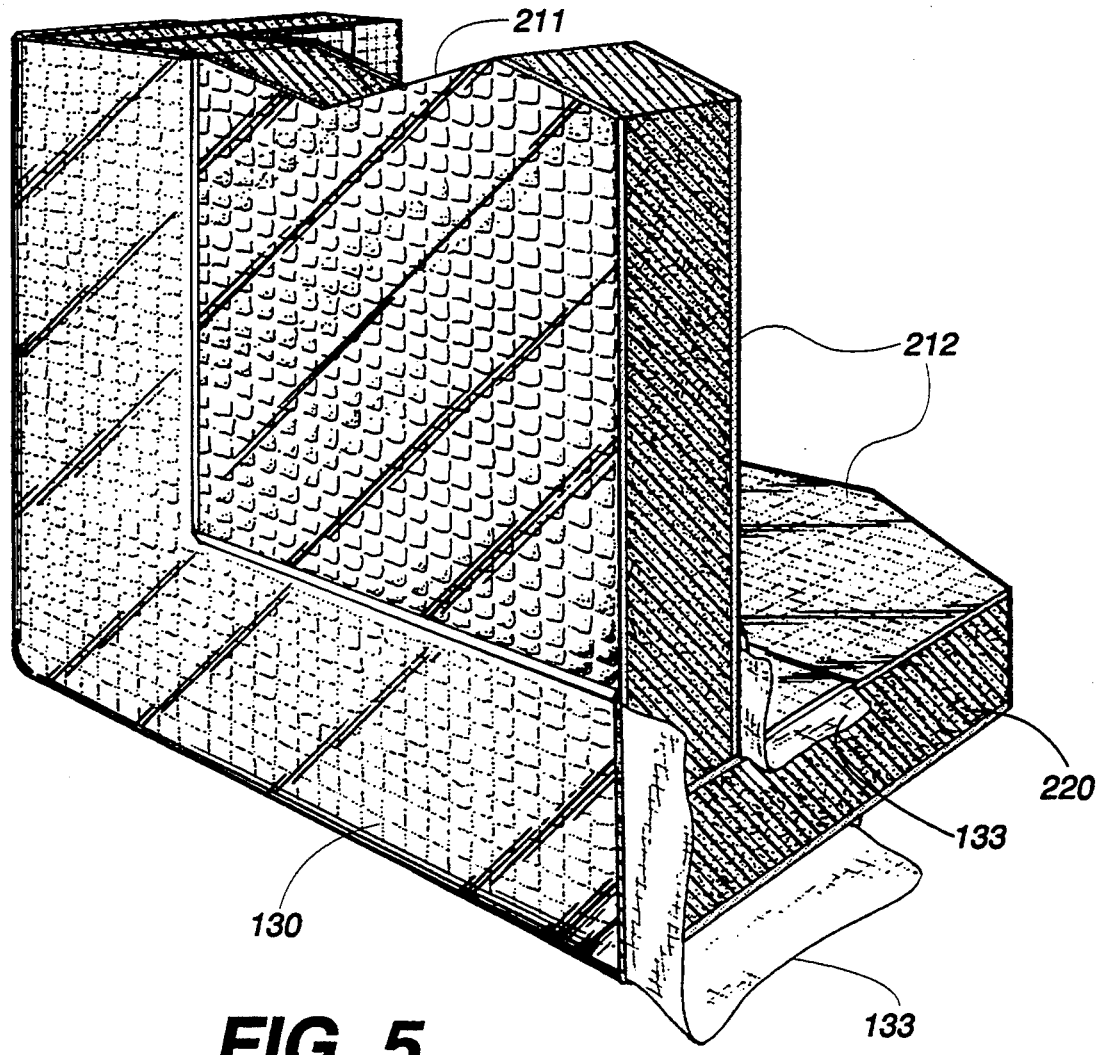
FIG. 5 is an enlarged perspective view of the connection of panels of FIG. 4 of the kiln of FIG. 1.
Figure 6:
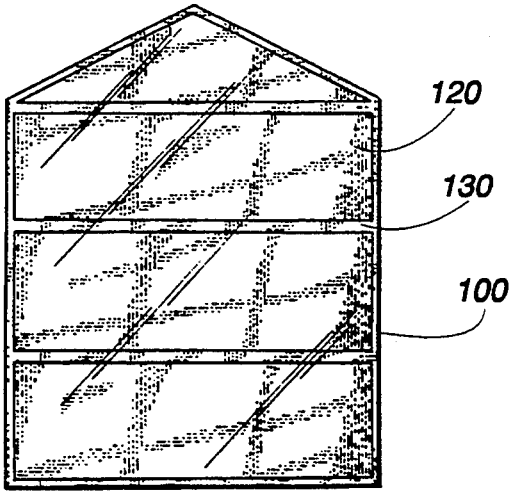
FIG. 6 is a rear elevational view of the kiln of FIG. 1.
Figure 7:
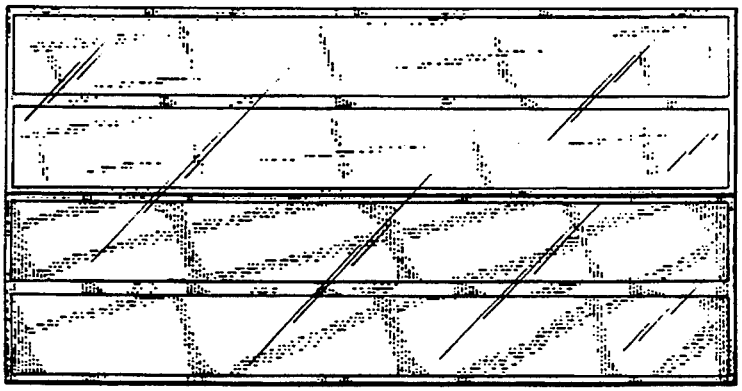
FIG. 7 is a top plan view of the kiln of FIG. 1.
Figure 8:
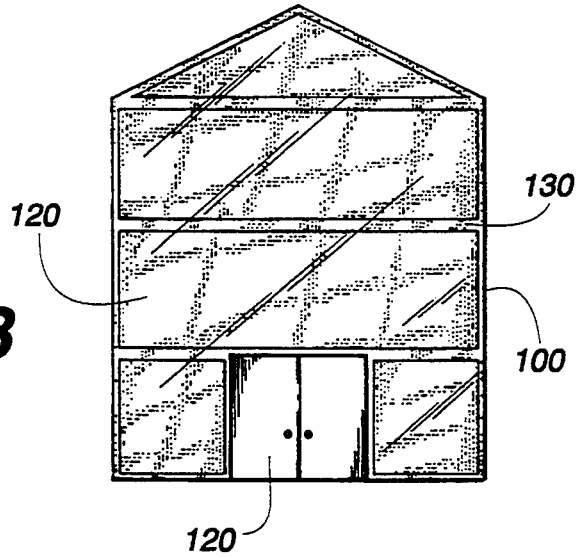
FIG. 8 is a front elevational view of the kiln of FIG. 1.

Connecting means 130 comprises multiple alternating layers of fiberglass mats 133 and resin 137 covering the joint between the panels 120. As shown in FIGS. 4 and 5, the mats 133 and the resin 137 thus serve to rigidly join two or more panels 120 together. The mat 133 and the resin 137 form a barrier in between each panel that is virtually impervious to moisture.

In operation, a set of panels 120 are joined as set forth above to form the building 100. Some of the panels 120 are joined to form doors 101. Equipment is installed to provide for heating and ventilating and for the control thereof. Curing of uncured lumber commences in a typical manner.

The embodiments of the invention in which an exclusive property or privilege is claimed are defined as follows:

1. An apparatus for insulating kilns, said apparatus comprising:

a paneling means having a moisture proof, highly acid resistant encapsulating means, which comprises a set of plates of fibrous glass strands embedded in a resin, insensitive to indigenous heat and a moisture resistant insulating means completely surrounded by, and sealed in by, the encapsulating means and a moisture proof, highly acid resistant means, insensitive to indigenous heat, for connecting the panels in a manner whereby a building is formed without diminishing the qualities of the encapsulating means.

2. A method for insulating kilns, said method comprising:

constructing a paneling means having a moisture proof, highly acid resistant encapsulating means, which comprises a set of plates of fibrous glass strands embedded in a resin, insensitive to indigenous heat and a moisture resistant insulating means completely surrounded by, and sealed in by, the encapsulating means by completely and sealably surrounding the insulating means with the encapsulating means and connecting the paneling means in a manner whereby a building is formed without diminishing the qualities of being waterproof, acid proof and temperature resistant.

* * * * *